US006868703B2

(12) United States Patent
Molzer

(10) Patent No.: US 6,868,703 B2
(45) **Date of Patent: *Mar. 22, 2005**

(54) HANDLE AND LOCK

(75) Inventor: Klaus Molzer, Jassjo (SE)

(73) Assignee: Austin Hardware, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/689,170

(22) Filed: Oct. 20, 2003

(65) Prior Publication Data

US 2004/0079124 A1 Apr. 29, 2004

Related U.S. Application Data

(60) Continuation of application No. 10/079,841, filed on Feb. 19, 2002, now Pat. No. 6,662,605, which is a division of application No. 09/448,646, filed on Nov. 24, 1999, now Pat. No. 6,354,119.

(51) Int. Cl.[7] ..... E05B 13/10

(52) U.S. Cl. ..... 70/210; 70/224; 70/215; 70/DIG. 31; 292/336.3

(58) Field of Search ..... 70/209–210, 207, 70/190, 215, 217, 224, 445, DIG. 31, DIG. 67; 292/336.3, 350, DIG. 59, DIG. 71

(56) References Cited

U.S. PATENT DOCUMENTS

| | | | | |
|---|---|---|---|---|
| 1,812,334 A | 6/1931 | Gloekler | 292/205 |
| 2,160,611 A | 5/1939 | Alexander | 292/348 |
| 2,459,920 A | 1/1949 | Clark | 70/223 |
| 2,473,937 A | 6/1949 | Cameron | 292/348 |
| 2,701,735 A | 2/1955 | Segal | 292/348 |
| 2,707,121 A | 4/1955 | Behnke | 292/228 |
| 2,851,871 A | 9/1958 | Newell | 70/150 |
| 2,949,328 A | 8/1960 | Kaiser | 292/207 |
| 3,159,994 A | 12/1964 | Schulz | 70/146 |
| 4,583,775 A | 4/1986 | Bisbing | 292/64 |
| 4,732,418 A | 3/1988 | Crown et al. | 292/207 |

(List continued on next page.)

*Primary Examiner*—Daniel P. Stodola
*Assistant Examiner*—Christopher Boswell
(74) *Attorney, Agent, or Firm*—Vidas, Arrett & Steinkraus, P.A.

(57) ABSTRACT

A handle and lock which generally includes a base having an index pin, a stop positioned in a circular channel, and an aperture traversing the base. A shaft is rotatably engaged to the base. The shaft includes a nut-shaped platform and an arcuate positioning limiter disposed in the circular working channel. The nut shaped platform preferably includes a threaded bore to receive a fastener used to releasably attach a handle to the shaft. The handle generally includes a head portion having a nut shaped receiving area and an arcuate protruding positioning member for placement within the circular working channel. The nut shaped receiving area preferably covers the platform during rotation of the handle relative to the base. The head portion may also include a lock having a locking barrier connected to a locking cylinder. The locking barrier is also adapted for removable positioning within the circular working channel to prevent rotation between the rotational limiter and the stop thereby restricting rotation of the handle and shaft relative to the base. The shaft further includes a latch member designed to engage a latch receiver integral to a door frame used for latching of a door in a closed position.

21 Claims, 4 Drawing Sheets

U.S. PATENT DOCUMENTS

| | | | | |
|---|---|---|---|---|
| 4,763,935 | A | 8/1988 | Bisbing | 292/66 |
| 5,172,944 | A | 12/1992 | Munich et al. | 292/39 |
| 5,184,853 | A | 2/1993 | Whatley | 292/205 |
| D343,347 | S | 1/1994 | Lau et al. | D8/301 |
| 5,292,189 | A | 3/1994 | Lau et al. | 312/265.3 |
| 5,299,597 | A | 4/1994 | Fort et al. | 137/385 |
| 5,390,517 | A | 2/1995 | Yamada | 70/210 |
| 5,408,853 | A | 4/1995 | Yamada | 70/210 |
| D360,345 | S | 7/1995 | Swan et al. | D8/308 |
| 5,469,725 | A | 11/1995 | Yamada | 70/208 |
| 5,481,889 | A | 1/1996 | Richard et al. | 70/118 |
| 5,509,703 | A | 4/1996 | Lau et al. | 292/1 |
| 5,520,427 | A | 5/1996 | Mader | 292/336.3 |
| D371,300 | S | 7/1996 | Mordick | D8/343 |
| 5,582,042 | A | 12/1996 | Mordick | 70/14 |
| 5,582,443 | A | 12/1996 | Finkelstein et al. | 292/202 |
| 5,620,290 | A | 4/1997 | Homfeldt et al. | 411/533 |
| 5,630,632 | A | 5/1997 | Swan | 292/240 |
| 5,634,357 | A | 6/1997 | Nutter et al. | 70/210 |
| 5,642,909 | A | 7/1997 | Swan et al. | 292/39 |
| 5,664,448 | A | 9/1997 | Swan et al. | 70/224 |
| 5,666,695 | A | 9/1997 | Jegers et al. | 16/381 |
| D385,768 | S | 11/1997 | Nutter et al. | D8/308 |
| 5,683,005 | A | 11/1997 | Mordick | 220/3.7 |
| 5,704,100 | A | 1/1998 | Swan | |
| D391,143 | S | 2/1998 | Jancsek | D8/308 |
| 5,722,121 | A | 3/1998 | Lau et al. | 16/381 |
| D396,397 | S | 7/1998 | Swan | D8/331 |
| D400,076 | S | 10/1998 | Jancsek et al. | D8/331 |
| 5,862,690 | A | 1/1999 | Jancek | 70/224 |
| 5,879,035 | A | 3/1999 | Jancek et al. | 292/202 |
| D411,433 | S | 6/1999 | Swan et al. | D8/306 |
| 6,068,308 | A | 5/2000 | Molzer | 292/336.3 |
| 6,086,308 | A | 7/2000 | Sjogren et al. | 414/373 |
| 6,101,856 | A | 8/2000 | Pelletier et al. | 70/472 |
| 6,318,770 | B1 | 11/2001 | Molzer | 292/241 |
| 6,354,119 | B1 | 3/2002 | Molzer | 70/210 |
| 6,474,119 | B1 | 11/2002 | Halvorson et al. | 70/208 |
| 6,662,605 | B2 * | 12/2003 | Molzer | 70/210 |

* cited by examiner

HANDLE AND LOCK

CROSS-REFERENCE TO RELATED APPLICATIONS

This application is a continuation application from U.S. application Ser. No. 10/079,841, filed Feb. 19, 2002, now issued U.S. Pat. No. 6,662,605 issued Dec. 16, 2003, which application is a divisional application of U.S. Utility application Ser. No. 09/488,646 filed Nov. 24, 1999, now U.S. Pat. No. 6,354,119 issued Mar. 12, 2002, the entire contents of all of which are incorporated herein by reference in their entireties.

BACKGROUND OF THE INVENTION

This invention relates to latches and more particularly relates to latch assemblies utilizing handles and handle latching mechanisms for use with ceiling and air conditioning, ventilation and/or refrigeration units or cabinets and the like.

Latch assemblies with handles are known which are lockable by utilization of an internal lock cylinder which prevent the handle from rotating. Typically these latch assemblies may be locked and unlocked and remain in the unlocked position whereby the handle and door attached thereto may be opened with one hand.

In the past, the handles as known for use with ceiling and/or air conditioning or refrigeration cabinets have not provided a desired level of insulating qualities to prevent thermal transfer from occurring within a compartment. In addition, the handles as known did not provide sufficient insulating qualities to prevent condensation or frosting from occurring upon the handle and the associated temperature increases, air pressure and/or heat transfer from escaping from the interior of a compartment. In addition, no handle is known which provides a thermal break or barrier to insulate a handle used on a ceiling/air conditioning or refrigeration cabinet to provide a temperature and/or air seal for a ventilation and/or refrigerated structure.

A handle surface having a reduced temperature frequently occurs due to the use of non-insulating grooves, handle shaft air leakage and set screws for affixation of the handle to a door. The use of grooves and set screws frequently enable air to leak through the grooves which in turn causes an air leakage to occur on the handle which in turn causes a condensation to form upon the door handle. In addition, the use of grooves and set screws for affixation of a handle to a ventilation and/or air conditioning door frequently result in the loss of cool air from the interior of a air conditioned compartment into a heated environment.

There has been minimal development of efficient and convenient latching assemblies which solve these identified problems. Additional locking features to accommodate a padlock may also be desirable for use with a ceiling and/or air conditioning cabinet. Further, prior art latch assemblies, particularly locking latch assemblies normally lack flexibility in being adaptable for varying applications, for example, a left or right handed application with a door for a ventilation and/or refrigerated structure.

BRIEF DESCRIPTION OF THE INVENTION

The present invention provides a latching assembly for a ceiling and/or air conditioning or refrigeration cabinet for establishment of an effective insulation thermal barrier to effectively thermally seal or insulate a compartment from the loss of air from within a structure. The thermal handle and latch includes a base having an index pin; a stop fixedly positioned in a circular working channel; an aperture traversing the base; a support stem positioned in the aperture for rotatably attaching the shaft to the base. The shaft includes a threaded end and an affixation end having a nut-shaped platform and arcuate positioning limiter. The positioning limiter is designed for rotational placement within the circular working channel and is further adapted to engage the stop. The nut-shaped platform further includes a centrally positioned threaded bore used to affix the handle to the shaft through the use of a threaded fastener. The handle includes a grasping end and head portion. The head portion includes a nut shaped receiving area and an arcuate protruding positioning member. The protruding positioning member is adapted for positioning and rotation within the circular working channel. The nut shaped receiving area preferably covers the nut shaped platform. The rotation of the handle causes the rotation of the nut shaped receiving area, and the arcuate protruding positioning member, which in turn cooperate to move the positioning limiter within the circular working channel towards or away from the stop during the latching or unlatching of a door to a structure. The central aperture further traverses the head portion of the handle and is adapted to receive the threaded fastener used to affix the shaft to a handle. A lock may also be included with the handle. The lock preferably is formed of a locking cylinder adapted to receive a key. The insertion of a key permits rotation of a locking cylinder to elevate one or more pins to permit the cylinder to be turned approximately 90° relative to the handle. At the distal end of the cylinder is preferably an arm having a worm gear which is rotatably engaged to teeth as integral to a linearly sliding arcuate locking barrier. Rotation of the key 90° clockwise causes the worm gear to rotate and to retract the linearly sliding arcuate locking barrier into a cavity and out of the circular working channel, thereby, permitting rotation of the handle, nut-shaped platform, arcuate positioning limiter, shaft and protruding positioning member for unlatching of the latch member as integral of the shaft from the keeper or latch receiver integral to the interior door frame during opening of a door for a refrigerated cabinet. An escutcheon is preferably affixed to the shaft between the interior of the door and the latch member to establish a thermal barrier preventing undesirable heat or cold transfer, frost and/or cooling loss through the handle, latch, and/or lock into an exterior environment.

The lock mechanism may include an arcuate locking or interference barrier which may slide linearly with respect to the shaft to prevent or permit rotation of the handle and shaft relative to the base. The locking or interference barrier may be operatively connected to the locking cylinder so that upon rotational movement of the key, the locking or interference barrier is brought into and out of engagement from the working channel in the base.

A principal object of the present invention is the provision of a ventilation and/or refrigeration handle and lock which is formed of relatively simply and inexpensive design, construction, and operation and which is safe and fulfills the intended purpose of providing a thermal barrier for a refrigerated compartment without risk of injury to persons and/or damage to property.

Another principal object of the present invention is the provision of a handle and lock which establishes a thermal barrier to prevent cooling of the handle when used upon a door for a ventilation and/or refrigerated structure.

Still another principal object of the present invention is the provision of a handle and lock which establishes a thermal barrier to enhance insulating properties of a ventilation and/or refrigeration structure by minimizing dissipation of cool air and the influx of heat through a structure into a refrigerated compartment.

Still another principal object of the present invention is the provision of a handle and lock which is energy and cost efficient.

Still another principal object of the present invention is the provision of a handle and lock which is flexible enabling either left handed or right handed operation.

Still another principal object of the present invention is the provision of a handle and lock which is flexible enabling an individual to use a thermal block or barrier with any preferred thickness of door used upon a refrigerated cabinet to enhance the insulating properties of the handle and lock.

Still another principal object of the present invention is the provision of a handle and lock which reduces condensation on the handle when used upon the door for a refrigerated structure.

Still another principal object of the present invention is the provision of a handle and lock which increases the comfort to individuals by minimizing cooling of the handle during use upon a door for a refrigerated structure.

Still another principal object of the present invention is the provision of a handle and lock which does not leak air and which provides a sealed refrigeration compartment.

Still another principal object of the present invention is the provision of a handle and lock which has improved compression properties thru adjustment.

A feature of the present invention is a provision of a handle and lock having a first thermal barrier between a base and the exterior surface of a door for a refrigerated structure.

Another feature of the present invention is a provision of a handle and lock having a thermal barrier between a shaft and the interior surface of a door for a refrigerated structure.

Still another feature of the present invention is a provision of a handle and lock having a thermal barrier which is positionable at a variety of locations relative to a base, shaft, and/or latch to improve insulating properties for a refrigerated structure.

Still another feature of the present invention is the provision of a handle and lock having a base formed of thermal insulating material.

Still another feature of the present invention is the provision of a handle and lock having a base having a housing defining a circular lip and a circular working channel.

Still another feature of the present invention is the provision of a handle and lock having an index pin adapted to engage a door to prevent rotation of the base relative to the door.

Still another feature of the present invention is the provision of a handle and lock having a base having a centrally positioned aperture and a support stem positioned in the aperture where the support stem rotatably connects a shaft to the base.

Still another feature of the present invention is the provision of a handle and lock having a base having an arcuate shaped stop positioned within the circular working channel to restrict the rotation of the shaft relative to the base.

Still another feature of the present invention is the provision of a handle and lock having a shaft having an elongate central support section terminating in a threaded section.

Still another feature of the present invention is the provision of a handle and lock having a shaft having an hexagonal shaped nut cap end having a centrally positioned threaded bore therein.

Still another feature of the present invention is the provision of a handle and lock having a shaft having a rotational limiter integral or affixed to the hexagonal shape nut cap end where the rotational limiter is adapted to engage the stop to restrict rotation of the handle relative to the base.

Still another feature of the present invention is the provision of a handle and lock having a handle having a head portion and a grasping portion.

Still another feature of the present invention is the provision of a handle and lock having a head portion having a centrally positioned aperture therethrough.

Still another feature of the present invention is the provision of a handle and lock having a handle having a head portion which includes an hexagonal shaped receiving area adapted to engage and cover the nut cap of the shaft.

Still another feature of the present invention is the provision of a handle and lock having a handle having a head portion which includes an arcuate shaped protruding positioning member adapted for positioning within the circular working channel and further adapting for engagement to the stop.

Still another feature of the present invention is the provision of a handle and lock formed of thermal insulating material.

Still another feature of the present invention is the provision of a handle and lock having a threaded fastener adapted for positioning through the aperture of the head portion and for engagement to the threaded bore of the shaft to secure the handle to the shaft.

Still another feature of the present invention is the provision of a handle and lock having thermal barrier escutcheon adapted for engagement to the shaft.

Still another feature of the present invention is the provision of a handle and lock having a thermal barrier escutcheon which includes a disk portion and cylindrical portion extending from the disk portion.

Still another feature of the present invention is the provision of a handle and lock having a thermal barrier escutcheon having an affixation face having a plurality of graspers adapted to securely affix the escutcheon to the shaft at any desired location.

Still another feature of the present invention is the provision of a handle and lock having an escutcheon having a disk portion which includes a lip and recessed portion adapted to receive a disk-shaped affixation face which includes a plurality of graspers.

Still another feature of the present invention is the provision of a handle and lock having an escutcheon having a disk-shaped affixation face which includes a centrally positioned opening which is aligned with the cylindrical portion to permit passing of the shaft therethrough.

Still another feature of the present invention is the provision of a handle and lock having a base having a disk-shaped housing which is securely attached to a base plate through a press fit.

Still another feature of the present invention is the provision of a handle and lock having an escutcheon formed of thermal insulating material.

Still another feature of the present invention is the provision of a handle and lock having one or more nuts and a latch member securely engaged to the shaft where rotation of the handle causes the latch member to rotate for latching or unlatching of a keeper or latch receiver affixed to a door frame for opening of a door to provide access to a refrigerated cabinet.

Still another feature of the present invention is the provision of a handle and lock having a handle having a cylindrical bore and a lock disposed in the cylindrical bore.

Still another feature of the present invention is the provision of a handle having a lock having a lock shaft including a worm gear.

Still another feature of the present invention is the provision of a handle and lock having an arcuate locking barrier having a plurality of teeth or grooves engaged to the worm gear for insertion or retraction of the arcuate locking barrier from positioning with the circular working channel thereby permitting rotation of the handle and shaft relative to the base to unlatch the latching member from the latch receiver to open the door of a ventilation and/or refrigeration cabinet.

Still another feature of the present invention is the provision of a handle and lock having a head portion which incudes an arcuate cavity adapted to hold the arcuate locking barrier.

Still another feature of the present invention is the provision of a handle and lock having a lock which may be released by a key which elevates pins permitting rotation of the lock cylindrical with the cylindrical bore.

Still another feature of the present invention is the provision of a handle and lock having a arcuate locking barrier positioned opposite the protruding positioning member and exterior to the nut receiving area.

Still another feature of the present invention is the provision of a handle and lock having a base having a cylindrical groove adapted for receiving engagement of a gasket used to form an air tight seal between the base and the exterior surface of a door for a refrigerated cabinet.

Still another feature of the present invention is the provision of a handle and lock having a base having a transition area between a circular lip and an interior ring.

Still another feature of the present invention is the provision of a handle and lock having a roller cam engaged to the head portion of the handle.

Still another feature of the present invention is the provision of a handle and lock having a roller cam having a central aperture and a body which enhance and structural strength of the head portion of the handle.

Still another feature of the present invention is the provision of a handle and lock having a roller cam having a rotatable sleeve to facilitate the ease of use of the handle.

Still another feature of the present invention is the provision of a handle and lock having a traversely extending second bore adapted to receive the roller cam.

Still another feature of the present invention is the provision of a handle and lock having a base having a centrally position aperture and a affixation stem positioned in the aperture where the affixation stem rotatably connects the shaft to the base.

BRIEF DESCRIPTION OF THE SEVERAL VIEWS OF THE DRAWING(S)

DETAILED DESCRIPTION OF PREFERRED EMBODIMENT

Figures 1, 2:
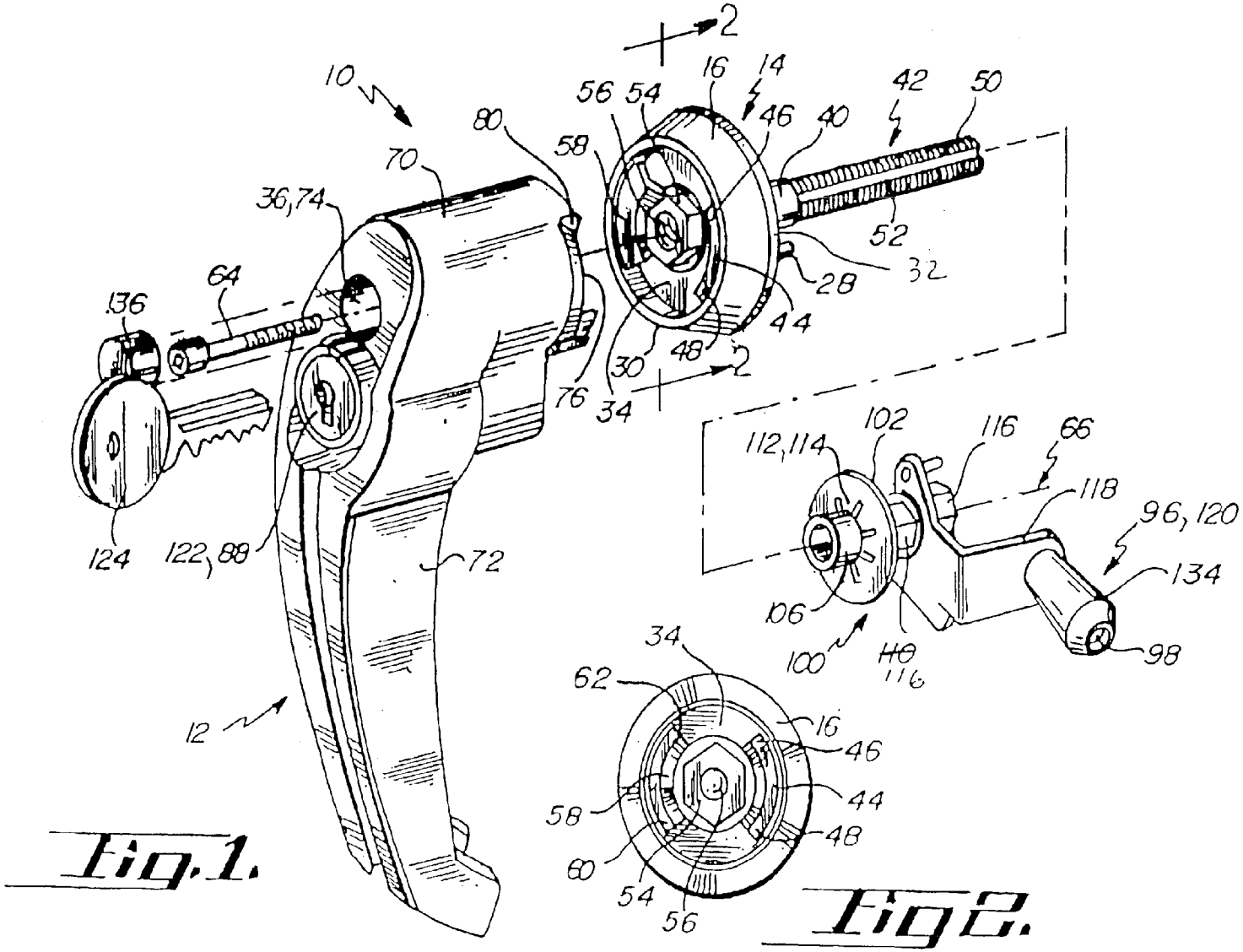
FIG. 1 is an exploded isometric view of the handle and lock showing the handle, base, shaft, escutcheon, and latching member.
FIG. 2 is an end view of the base taken along the line 2—2 of FIG. 1.

While this invention may be embodied in many different forms, there are described in detail herein specific preferred embodiments of the invention. This description is an exemplification of the principles of the invention and is not intended to limit the invention to the particular embodiments illustrated.

One form of the handle and lock is illustrated and described herein. In general, the handle and lock is illustrated by the numeral 10. The handle and lock 10 is preferably designed for use with refrigeration units, ventilation units, ceiling and air conditioning units and/or refrigerated cabinets. The handle and lock 10 may be used to thermally insulate a refrigerated environment from ambient or heated temperature conditions within an adjacent room. The handle and lock 10 preferably prevents perspiration and/or frost from accumulating upon, or the cooling of, the handle 12 which may be undesirable to individuals. The handle and lock 10 is preferably formed of thermal insulating materials which assist to seal and prevent air flow from traversing an insulated refrigerator door. In addition, the handle and lock 10 as formed of the thermal insulating materials preferably reduces the cooling of the handle 12 and base 14 positioned adjacent to the exterior of a refrigerated cabinet. Cost and energy efficiency for a refrigerated unit is thereby enhanced. It should be noted that the handle and lock 10 is preferably adapted for either left or right handed operation or rotation at the discretion of an individual dependent upon the orientation of the base 14 relative to an insulated door.

The base 14 is preferably formed of a disk shaped housing 16 which is formed of thermally insulating material. The rear surface of the disk shaped housing 16 preferably includes a circular recessed portion 18 which is preferably adapted for receiving engagement of the rear face member 20. The rear face member 20 preferably has an elevated central portion 22 which preferably defines a circular groove 24 which is adapted for receiving engagement of a thermally insulating gasket 26. The rear face member 20, elevated central portion 22 and gasket 26 are preferably adapted for positioning adjacent to a thermally insulated door of a ventilation and/or refrigeration cabinet.

An index pin 28 preferably extends outwardly from the elevated central portion 22. The index pin 28 is preferably adapted for penetrating engagement into a hole within a refrigerated door or cabinet. The positioning of the index pin 28 within the hole prevents rotation of the base 14 relative to the insulated door during use of the handle and lock 10. It should be noted that the location of the index pin 28 and hole within the thermally insulated door may dictate whether the handle and lock 10 may be rotated in either a left handed or right handed manner for use by an individual.

The disk shaped housing 16 of the base 14 preferably functions as a transition area between a circular lip 30 and an interior ring 32 which is positioned proximate to the circular recessed portion 18 and rear faced member 20.

A recessed circular working channel 34 is interior to the circular lip 30. A centrally positioned aperture 36 preferably traverses the base 14 and the rear face member 20.

A support stem 38 formed of thermally insulating material is preferably positioned within the centrally positioned aperture 36 through the rear faced member 20. The support stem 38 preferably has an outwardly extending collar portion 40. The support stem 38 is preferably adapted for rotatable engagement to a shaft 42. The support stem 38 is preferably positioned within the centrally positioned aperture 36 and engaged to the rear faced member 20 through a press fit. The support stem 38 is also formed of the thermally insulating material which preferably functions as a thermal barrier to prevent temperature loss through the insulating door.

An arcuate shaped stop 44 is preferably positioned within the recessed circular working channel 34. The arcuate shaped stop 44 preferably has a first end 46 and a second end 48. The arcuate shaped stop 44 preferably functions to restrict the rotation of the shaft 42 relative to the base 14 during rotation of the handle 12 for opening of the thermally insulated door of a refrigerated cabinet or structure.

As may be seen in FIG. 1, the shaft 42 preferably extends through the centrally positioned aperture 36 of the base 14. The shaft 42 also preferably passes through the support stem 38 and is rotatably connected to the outwardly extending collar portion 40.

The shaft 42 preferably includes a threaded section or end 50, an elongate central support section 52 and a hexagonal shaped nut cap end or platform 54. A threaded bore 56 is preferably positioned centrally within the hexagonal shaped nut cap end 54 as may be seen in FIGS. 1 and 2. A rotational limiter 58 is preferably integral or affixed to the hexagonal shaped nut cap end or platform 54. The rotational limiter is preferably adapted for positioning in the recessed circular working channel 34 opposite to the stop 44. The rotational limiter 58 is preferably adapted for rotation within the working channel 34 during manipulation of the handle 12.

The rotational limiter 58 preferably includes a third end 60 and a fourth end 62. The rotational limiter 58 is preferably arcuate in shape and is a mirror image of the stop 44.

The threaded bore 56 is preferably adapted to receive a threaded fastener 64 which may be utilized to affix the handle 12 to the base 14. It should be noted that the nut cap end or platform 54 may be hexagonal, octagonal, square, triangular, and/or rectangular at the preference of an individual. It should further be noted that the rotational limiter 58 is not restricted to an arcuate shape for positioning within the working channel 34.

During rotation of the handle 12, the fourth end 62 of the rotational limiter 58 is preferably adapted for engagement to the first end 46 of the stop 44 to limit rotation of the handle 12 from a first position 140 which is substantially vertical, to a second position 142 which is substantially horizontal with respect to a ground or floor surface (FIGS. 9–12). It should be noted that during rotation of the shaft 42 the base 14 via the use of the index pin 28 is maintained in a stationary position relative to a door surface. It should further be noted that the support stem 38 and outwardly extending collar portion 40 are also maintained in a stationary position relative to a door surface during rotation of the nut cape end or platform 54, shaft 42, and/or rotational limiter 58 during the unlatching of a door. The stop 44 is also maintained in a stationary position following the fastening of the base 14 to a refrigerated door surface.

The rotation of the nut cap end or platform 54 causes the fourth end 62 of the rotational limiter 58 to arcuately move within the recessed working channel 34 for contact with the first end 46 of the stop 44 to limit rotation therebetween. The engagement between the fourth end 62 and the first end 46 of the stop 44 preferably defines the second position 142 for the handle 12 permitting release of the latch 66 from a latch receiver 68 which may be integral or affixed to the interior door frame for a refrigerated cabinet and/or structure.

The handle 12, head portion 70, and/or grasping portion 72 are preferably formed of thermally insulating material designed to resist heat or cold transfer through the shaft 42 and base 14 to the handle 12.

As may be seen in FIGS. 1, 3, 4, 5, and 6, the handle 12 preferably includes a head portion or end 70 and a grasping portion or end 72. A central aperture 74 preferably traverses the head portion 70 in a direction normal to the centrally positioned aperture 36 and is adapted for alignment therewith. The central aperture 74 is preferably adapted for receiving engagement of the threaded fastener 64 used for affixation of the head portion or end 70 to the base 14. It should be noted that the threaded fastener 64 is preferably adapted for passing through the central aperture 74 and into the threaded bore 56 to affix the head portion 70 to the base 14.

Figure 3:
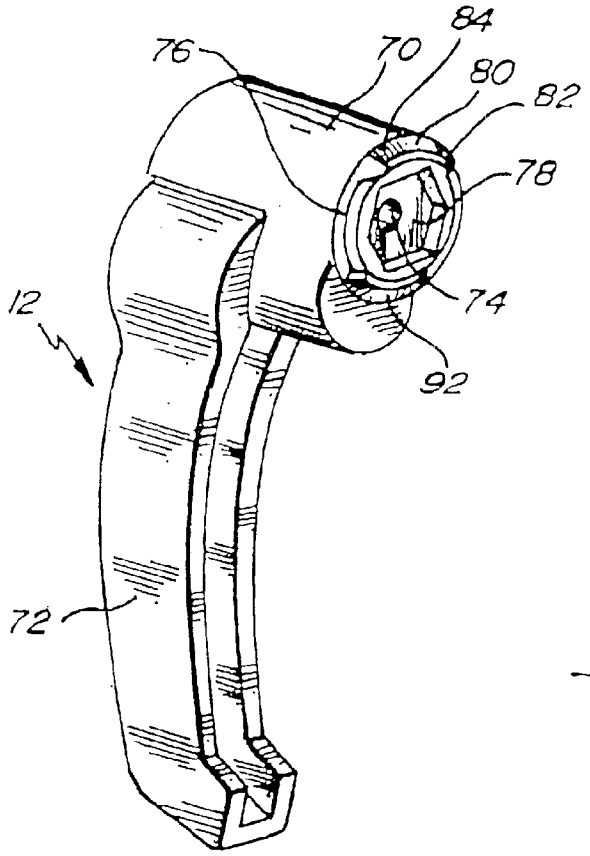
FIG. 3 is an isometric view of the handle.
Figure 4:
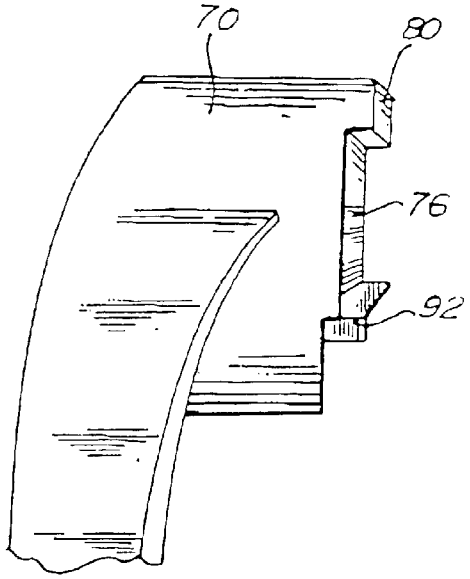
FIG. 4 is a side view of the head portion of the handle.
Figure 5:
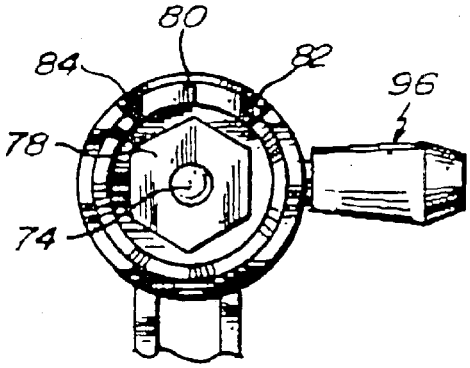
FIG. 5 is an end view of the head portion of the handle having a roller cam.

The head portion or end 70 preferably includes a front face 76. The front face 76 preferably includes a nut or hex shaped receiving area 78 which is preferably adapted to cover the hexagonal shaped nut cap end or platform 54 (FIG. 3). Proximate to the top of the front face 76 is preferably located an arcuate shaped protruding positioning member 80 which is preferably adapted for penetrating placement within the working channel 34 between the stop 44 and the rotational limiter 58. The protruding positioning member 80 preferably includes a fifth end 82 and a sixth end 84.

The arcuate shaped protruding positioning member 80 is preferably adapted for rotational movement within the working channel 34 during rotation of the grasping portion 72 from the first position 140 to the second position 142 (FIGS. 9–12).

The head portion 70 may further include a lock bore 86 which is preferably designed for receiving engagement of a locking cylinder 88. The lock bore 86 preferably extends normally to the direction of the central aperture 74 and is positioned between the central aperture 74 and the grasping portion 72 of the handle 12.

The head portion 70 further includes an arcuate lock cavity 90 which is in communication with the lock bore 86. An arcuate locking barrier 92 is preferably disposed in the lock cavity 90 and is in communication with the lock bore 86 for locking of the handle 12 in a first position 140 relative to the base 14 during periods of non-use.

A traverse bore 94 may be provided to extend through the head portion 70 perpendicular to the central aperture 74. The traverse bore 94 preferably crosses the central aperture 74 and is adapted to receive a roller cam 96 which may be rotatably affixed to the head portion 70 via the use of a fastener 98.

An escutcheon 100 is preferably affixed to the threaded section or end 50 of the shaft 42. The escutcheon 100 is preferably formed of thermal insulating material which prevents the transfer of cooled air through the shaft from the interior of a refrigerated compartment.

The escutcheon 100 is preferably formed of a disk portion 102 having a face. A cylindrical stem portion 106 preferably extends outwardly from the face. The cylindrical stem portion 106 includes a central opening adapted for receiving engagement of the shaft 42.

A disk shaped affixation face 112 having a plurality of graspers and/or fingers 114 is preferably press fit to the disk portion 102. Alternatively, the disk shaped affixation face 112 may be snap fit within the disk portion 102 at the preference of an individual.

The disk shaped affixation face 112 preferably has a centrally positioned opening which is aligned with the opening through the cylindrical stem portion 106 for passing engagement of the shaft 42 therethrough.

The escutcheon 100 is preferably affixed to the shaft 42 between the interior of a door and the latch member 66. The graspers and/or fingers 114 of the disk shaped affixation face 112 are preferably lockingly engaged to the threads of the threaded section 50 of the shaft 42 to prevent separation therebetween. The cylindrical stem portion 106 of the escutcheon 100 is preferably adapted for positioning within the opening which traverses a thermally insulated door for positioning of the face adjacent to the interior door surface. The use of the escutcheon 100 preferably creates a thermal block and/or barrier between the interior of the door and shaft 42 which promotes the insulating properties of the handle and lock 10 to thermally insulate a refrigerated compartment. The use of the escutcheon 100 upon the shaft 42 preferably prevents heat transfer along the shaft 42 reducing condensation or frost upon the handle 12. Further, the use of the escutcheon 100 as affixed to the shaft 42 preferably minimizes and/or prevents the leaking of air through the opening traversing an insulated thermal door and in conjunction with the base 14 prevents the exit of cooled air from the interior of a refrigerated structure.

Again referring to FIG. 1, the latch member 66 may be secured to the threaded section 50 of the shaft 42 via the use of one or more nuts 116. The latch member 66 may be formed of a bracket 118 which may be L-shaped or any other shape as preferred by an individual. The latch member 66 may include a roller cam 120 which may be rotatably secured to a bracket 118 via the use of a fastener. The latch member 66, bracket 118 and roller cam 120 are preferably securely engaged to the shaft 42 where rotation of the handle 12 causes the elevation of the latch member 66 upwardly for unlatching of a keeper and/or latch receiver which may be affixed to or is integral with the interior door frame of a thermally insulated door. The rotation of the handle 12 and the disengagement between the latch member 66 and the keeper and/or latch receiver permits opening of a thermally insulated door to provide access into a refrigerated cabinet.

Figure 7:
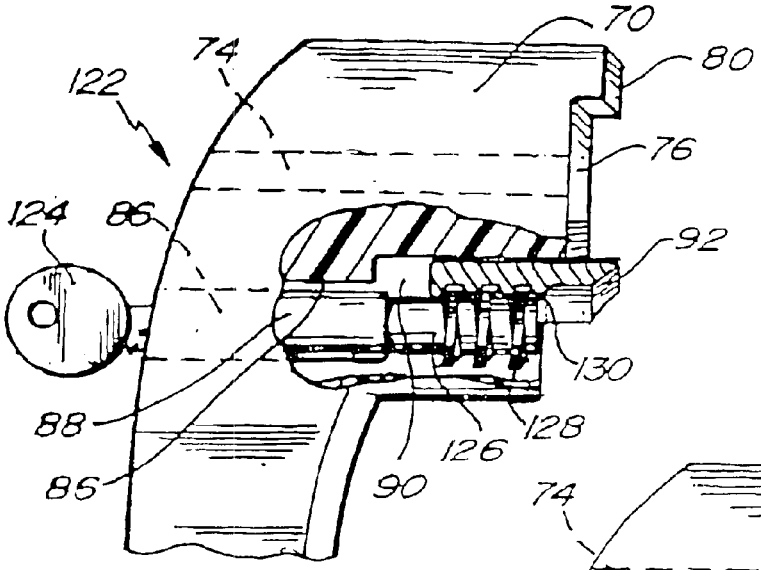
FIG. 7 is a partial cutaway view of the head portion showing the locking cylinder and extended locking barrier.
Figure 8:
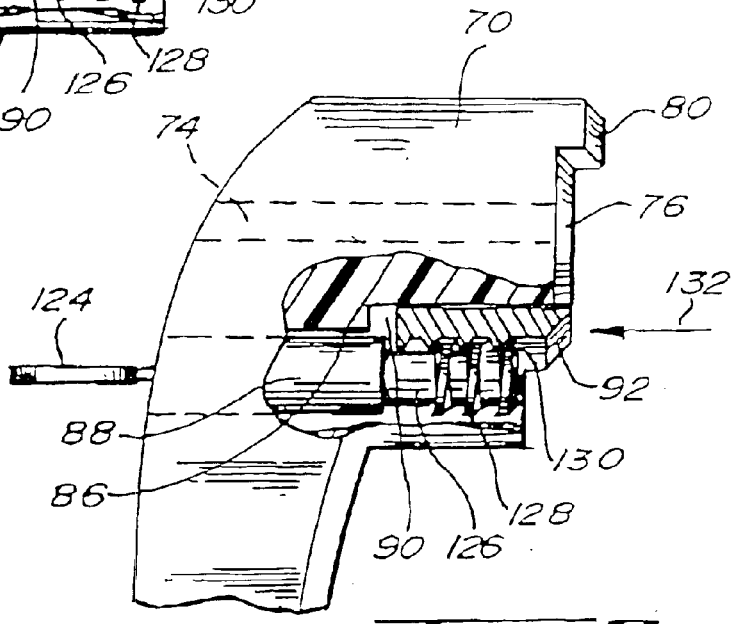
FIG. 8 is an alternative partial cutaway view of the head portion showing the locking cylinder and the retracted locking barrier.
Figure 13:
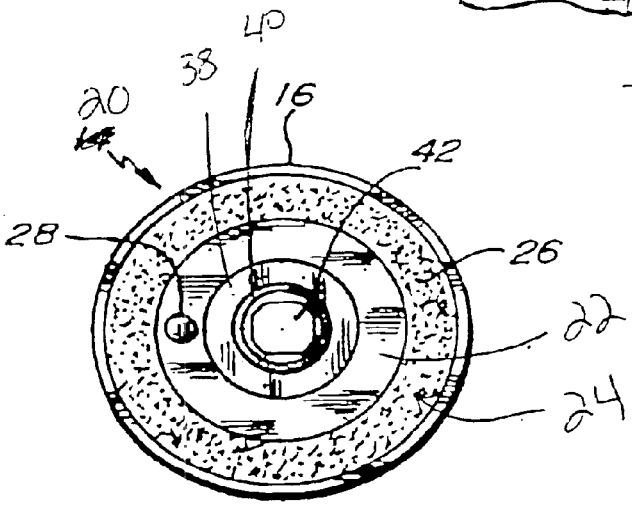
FIG. 13 is a rear view of the base.

As may be seen in FIGS. 7 and 8, a lock 122 is depicted as positioned within the lock bore 86. The lock 122 is preferably formed of a locking cylinder 88 which may be operated by a key 124. Rotation of the key 124 preferably elevates locking pins (not shown) permitting rotation of a locking shaft 126. The locking shaft 126 preferably includes a worm gear 128 which rotates as the key 124 is manipulated. The lock 122, and locking cylinder 88 are preferably disposed within the lock bore 86.

The arcuate locking barrier 92 is preferably disposed within the lock cavity 90 adjacent to the locking shaft 126 and worm gear 128. The arcuate locking barrier 92 preferably includes a plurality of teeth 130 which are coupled to the worm gear 128. The rotation of the key 124 thereby provides for the linear positioning of the arcuate locking barrier 92 into and out of the lock cavity 90 and into or out of the circular working channel 34 when the head portion 70 is affixed to the base 14.

The arcuate locking barrier 92 is preferably positioned within the working channel 34 opposite to the protruding positioning member 80 between the stop 44 and the rotational limiter 58. The arcuate locking barrier 92 as positioned within the working channel 34 prevents rotation of the protruding positioning member 80 and rotational limiter 58 within the working channel 34 thereby fixedly positioning the handle 12 relative to the base 14. The manipulation of the key 124 and locking cylinder 88 preferably retract the arcuate locking barrier as depicted by arrow 132 of FIG. 8 into the lock cavity 90 permitting rotation of the protruding positioning member 80 and rotational limiter 58 within the working channel 34 to permit elevation of the handle 12 to unlatch the latch member 66 from the keeper/receiver for opening of a thermally insulated door.

Rotation of the key 124 causes the worm gear 128 to rotate and to retract the linear sliding arcuate locking barrier 92 from the working channel 34 into the lock cavity 90 which in turn permits rotation of the handle 12, nut shaped platform 54, arcuate protruding positioning member 80, rotational limiter 58, and shaft 42 for unlatching of a thermally insulated door.

Figure 9:
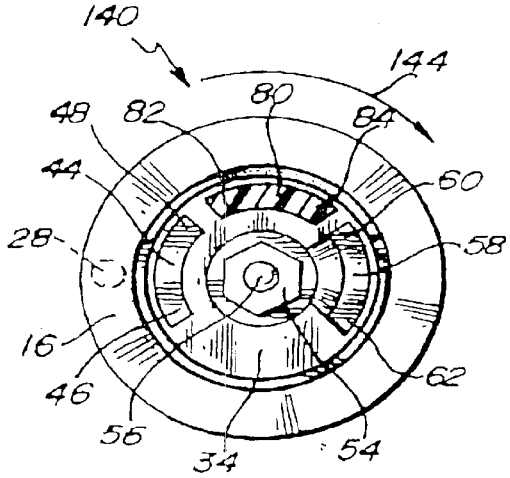
FIG. 9 is a cross-sectional end view of the base taken along the line of 2—2 of FIG. 1.

The locking barrier 92 may be securely positioned within the lock cavity 90 by any preferred means including but not limited to the use of fasteners and/or snaps. The lock cavity 90 is preferably positioned above the lock bore 86 proximate to the front face 76 of the head portion 70. The locking barrier 92 may include a first rotational restrictor to prevent outward separation of the teeth 130 from the worm gear 128 and the separation of the locking barrier 92 from the lock cavity 90. In addition, the locking barrier 92 may include a second rotational restrictor to limit the retraction of the locking barrier 92 within the lock cavity 90 where the forward surface of the locking barrier 92 is flushly aligned with the front face 76 as depicted in FIG. 8. As depicted in FIG. 9, the locking barrier 92 preferably extends forwardly approximately the same distance as the protruding positioning member 80 for insertion into the working channel 34.

Figure 6:
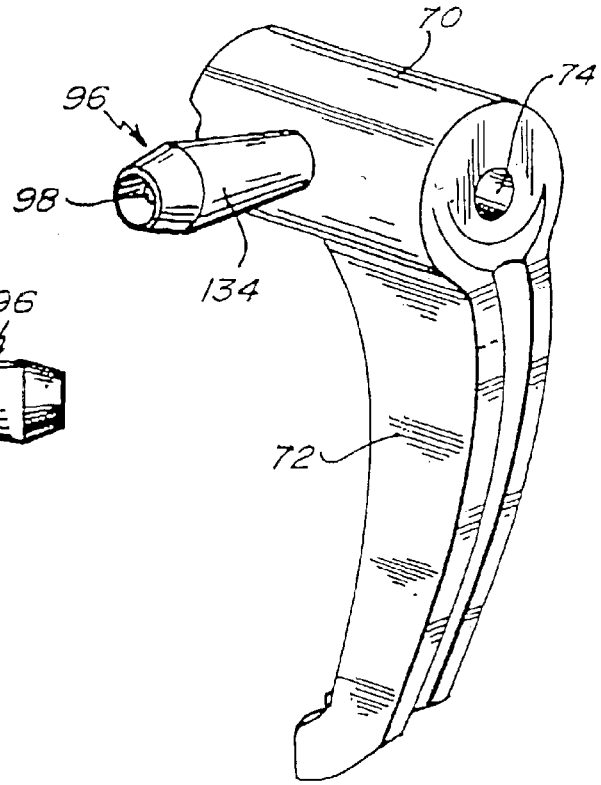
FIG. 6 is an alternative isometric view of the handle having a roller cam.

As may be seen in FIGS. 1 and 6, a roller cam 96 may be engaged to head portion 70 or to the latch member 66 at the preference of an individual. In general, the roller cam 96 is mounted upon either the head portion 70 or latch 66 via the use of a fastener 98. The roller cam 96 may also include a sleeve member 134 which may freely rotate relative to the fastener 98 at the preference of an individual. The roller cam 96 as secured to the head portion 70 preferably facilitates the manipulation of the handle 12 between the first latch position 140 and the second unlatched position 142 during the opening of a thermally insulated door. The roller cam 96 as affixed to the latch 66 preferably facilitates the engagement and disengagement of the latch 66 to the latch receiver 68 during the latching and/or release of the thermally insulated door from the interior door frame of a refrigerated compartment.

It should be noted that the roller cam 96 may be attached to either the head portion 70 and/or the latch member 66 by any means as preferred by an individual. It should further be noted that the fastener 98 used to secure the roller cam 96 to the head portion 70 preferably does not extend through the centrally positioned aperture 36 for interference with the fastener 64 used to attach the handle 12 to the base 14. Alternatively, the fastener 98 may include an opening which will permit the passing of the fastener 64 through the handle 12, centrally positioned aperture 36, and base 14 when the roller cam fastener 98 is secured to the head portion 70.

In an alternative embodiment, the exterior surface of a thermally insulated door may include a padlock bracket having an aperture which is adapted for positioning adjacent to a padlock tab which may be affixed, or may be integral to, the head portion 70 of the handle 12. The alignment between the aperture of the padlock tab and the padlock bracket may permit the use of a secondary padlock for affixation of the handle 12 in the first lock position to securely seal the thermally insulated door for a refrigerated compartment.

As depicted in FIG. 1, a plug cap 136 may be used for placement over the exterior end of the fastener 64 and insertion within the distal end of the centrally positioned aperture 74, 36 to provide a flush rearward surface for the head portion 70. The use of the plug cap 136 may also reduce the risk of tampering and/or the undesirable separation of the head portion 70 from the base 14. The plug cap 36 may include one or more penetrating affixation tabs which may be utilized to permanently attach the plug cap 136 within the centrally positioned aperture 74, 36 following assembly of the handle and lock 10.

Referring to FIGS. 9–12, the interaction between the handle 12 and the base 14 is shown. Referring to FIG. 9, the left handed operation of the handle and lock 10 is shown. The base 14 is depicted where the index pin 28 is positioned at a compass location of approximately 270° where the handle 12 is positioned downwardly. The first position 140 of the handle 12 is shown. In this configuration, the stop 44 is depicted proximate to the index pin 28 where the first end 46 is positioned downwardly relative to the second end 48. Opposite to the stop 44 is preferably located the rotational limiter 58. The fourth end 62 of the rotational limiter 58 is preferably positioned downwardly with respect to the third end 60. Between the second end 48 and the third end 60 is preferably located the protruding positioning member 80 where the fifth end 82 is adjacent to the second end 48 and the sixth end 84 is adjacent to the third end 60. The locking barrier 92 has been retracted from a position between the first end 46 and the fourth end 62 within the working channel 34.

Figure 10:
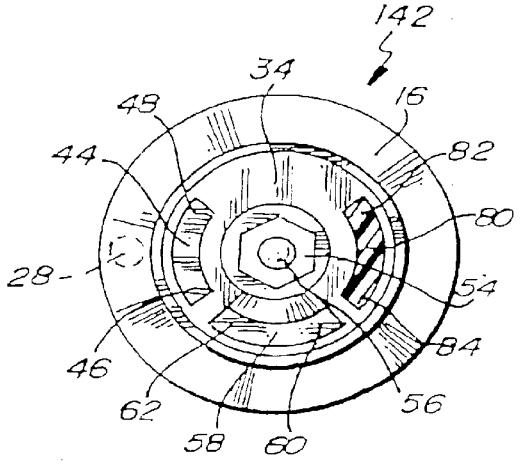
FIG. 10 is an alternative end view of the base taken along the line of 2—2 of FIG. 1.

Directional arrow 144 of FIG. 9 represents the rotational elevation of the handle 12 upwardly towards the left from a vertical orientation of the first position 140 to a perpendicular horizontal second position 142 for release of the latch 66 from the latch receiver 68 for the opening of a thermally insulated door from the door frame for a refrigerated compartment. It should be noted that the rotation of the handle 12 as indicated by directional arrow 144 may only occur upon the retraction of the locking barrier 92 from the working channel 34 as earlier described. In the second position 142 as indicated in FIG. 10, the protruding positioning member 80 as integral to the handle 12 and the rotational limiter 58 as integral to the nut cap end 54 of the shaft 42 have been rotated within the working channel 34 towards the stop 44. In the second position 142 the fourth end 62 of the rotation limiter 58 is adjacent to the first end 46 of the stop 44. The sixth end 84 of the positioning member 80 is adjacent to the third end 60 of the rotational limiter and a space has been provided between the second end 48 of the stop 44 and the fifth end 82 of the positioning member 80.

Figure 11:
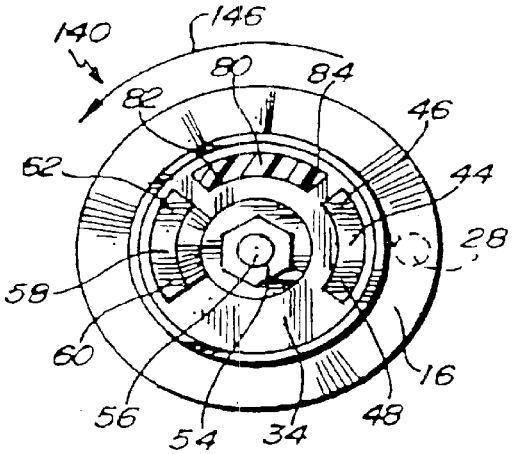
FIG. 11 is an alternative cross-sectional end view of the base taken along the line of 2—2 of FIG. 1.
Figure 12:
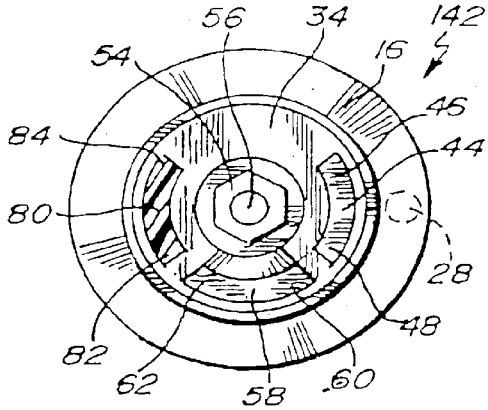
FIG. 12 is an alternative end view of the base taken along the line of 2—2 of FIG. 1.

As may be seen in FIGS. 11 and 12, the right handed operation of the handle and lock 10 is depicted. In FIG. 11, the index pin 28 is preferably positioned at a compass location of approximately 90° where the handle 12 is downward for right handed operation. FIG. 11 represents the handle 12 positioned in the first position 140 relative to the base 14. In this configuration the stop 44 is proximate to the index pin 28 where the first end 46 is positioned above the second end 48. Opposite to the stop 44 is preferably located the rotation limiter 58 where the fourth end 62 of the rotation limiter 58 is above the third end 60. The protruding positioning member 80 is disposed between the first end 46 and the fourth end 62. It should be noted that the fifth end 82 of the positioning member 80 is proximate to the fourth end 62 of the rotation limiter and the sixth end 84 of the positioning member 82 is proximate to the first end 46 of the stop 44. Upon the retraction of the locking barrier 92 within the lock cavity 90, rotation of the handle 12 relative to the base 14 may occur as indicated by directional arrow 146.

The rotation of the handle 12 upwardly from vertical to the right from the first position 140 to the perpendicular horizontal second position 142 preferably in turn releases the latch 66 from the latch receiver 68 permitting the thermally insulated door to be opened relative to a door frame of a refrigerated compartment. Upon acquisition of the second position 142 the relative locations of the stop 44, rotation limiter 58 and protruding positioning member 80 are depicted in FIG. 12. In this configuration the third end 60 of the rotation limiter 58 is adjacent to the second end 48 of the stop 44. In addition, the fifth end 82 of the positioning member 80 is adjacent to the fourth end 62 of the rotation limiter 58. Further, an opening has been established within the working channel 34 between the sixth end 84 of the positioning member 80 and the first end 46 of the stop 44.

It should therefore be noted that the handle and lock 10 as illustrated and described herein may be easily adaptable for either right handed or left handed use dependent upon the positioning of the index pin 28 relative to the exterior surface of a thermally insulated door for a ventilation and/or refrigeration compartment. An individual may easily position the index pin at either the 90° or 270° direction relative to the exterior of a thermally insulated door to enable right handed or left handed operation of the handle 12 at the discretion of an individual.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A latch assembly adapted for attachment to a door in a door frame, the latch assembly comprising:

a) a base having a recessed working channel, an aperture, and a stop positioned in the working channel;

b) a shaft extending through the aperture, said shaft having a rotational limiter, said rotational limiter being positioned in said working channel said stop being separated from said rotational limiter within said working channel; and c) a handle fixed to the shaft whereby the handle and shaft are at least partially rotatable with respect to the base between a first position and a second position, the handle being connected to the shaft, the handle having a grasping portion and a protruding positioning member said protruding positioning member constructed for movement between said stop and said rotational limiter.

2. The latch assembly of claim 1, said shaft comprising a nut cap end.

3. The latch assembly of claim 2, said handle comprising a head portion connecting to the shaft.

4. The latch assembly of claim 3, wherein said grasping portion extends from said head portion, the head portion configured for engagement with the base.

5. The latch assembly of claim 4, the bead portion comprising a nut receiving area, the nut receiving area adapted for positioning over the nut cap end.

6. The latch assembly of claim 5, said stop comprising a first end and a second end wherein the stop is fixedly positioned within said working channel.

7. The latch assembly of claim 6, said rotational limiter comprising a third end and a fourth end, said fourth end being adapted to engage said first end of said stop during rotation of said handle from said first position to said second position.

8. The latch assembly according to claim 7, said protruding positioning member comprising a fifth end and a sixth end.

9. The latch assembly according to claim 8, wherein said fifth end is adapted to engage said second end and said sixth end is adapted engage said third end when said handle is at said first position.

10. The latch assembly according to claim 8, wherein said fifth end engages said second end and said fourth end engages said first end when said handle is at said second position.

11. The latch assembly according to claim 7, wherein said protruding positioning member is adapted for positioning in said working channel between said second end and said third end.

12. The latch assembly of claim 5, said base further comprising a support stem positioned in said aperture.

13. The latch assembly of claim 12, said base further comprising an index pin extending from said base.

14. The latch assembly of claim 12, wherein said shaft is rotatably engaged to said support stem.

15. The latch assembly of claim 5, wherein said stop is arcuate in shape.

16. The latch assembly according to claim 3, said handle further comprising a lock bore through said head portion.

17. The latch assembly of claim 2, wherein said rotational limiter is integral to said nut cap end.

18. The latch assembly of claim 1, wherein said stop and said rotational limiter are disposed at substantially opposite locations within said working channel.

19. The latch assembly of claim 1, wherein said protruding positioning member is arcuate in shape.

20. The latch assembly according to claim 1, further comprising an escutcheon engaged to said shaft.

21. The latch assembly according to claim 20, said escutcheon comprising; a plurality of graspers adapted to engage said shaft.

* * * * *